US005669645A

United States Patent [19]

Chuang

[11] Patent Number: 5,669,645

[45] Date of Patent: Sep. 23, 1997

[54] HANDHELD GRABBING ASSEMBLY FOR GRABBING WASTE

[76] Inventor: Yi-Chang Chuang, 4F, No. 516, Mintsu E. Rd., Taipei City, Taiwan

[21] Appl. No.: 761,196

[22] Filed: Dec. 6, 1996

[51] Int. Cl.[6] ..... A01K 29/00; E01H 1/12

[52] U.S. Cl. ..... 294/1.3

[58] Field of Search ..... 294/1.3–1.5, 16, 294/25, 99.1; 15/104.8, 257.1, 257.4, 257.6; 53/390; 119/161; 141/391; 248/95, 97, 99

[56] References Cited

U.S. PATENT DOCUMENTS

| | | | |
|---|---|---|---|
| 4,273,370 | 6/1981 | Kjaer | 294/1.3 |
| 5,385,376 | 1/1995 | Malaspina | 294/1.3 |
| 5,476,296 | 12/1995 | Gross | 294/1.3 |

*Primary Examiner*—Johnny D. Cherry
*Attorney, Agent, or Firm*—Fish & Richardson P.C.

[57] ABSTRACT

A handheld grabbing assembly includes a plastic bag supplying device and a grabbing device. The plastic bag supplying device includes a spindle, a spool mounted rotatably on the spindle, and a reel of continuous plastic bags wound around the spool for reeling out a leading plastic bag to be torn off from the reel. The grabbing device includes first and second clutching arm members, each of which has a clutching blade end section and a handgrip end section. Each of the handgrip end sections includes an elongated frame body that extends parallel to the clutching blade end section, two lug members that respectively and transversely extend from two lateral sides of the elongated frame body and which respectively define a first axle hole to be journalled by each end of the spindle, and an internal boss on an inner surface of a respective one of the lug members around the first axle hole. A biasing member is disposed on the internal boss member to bias the clutching blade end sections toward each other. When the handgrip end sections are turned around the spindle against the biasing action of the biasing member, the clutching blade end sections will be gaped from each other.

9 Claims, 6 Drawing Sheets

HANDHELD GRABBING ASSEMBLY FOR GRABBING WASTE

BACKGROUND OF THE INVENTION

1. Field of the Invention

This invention relates to a grabbing assembly, more particularly to a handheld grabbing assembly for picking up waste which, when left unattended, may cause hazard to the environment.

2. Description of the Related Art

Some urban dwellers are in the habit of breeding pets, such as dogs, in their homes for recreation purposes. When taking a dog out for a walk, a common problem usually encountered by the pet owner is the disposal of dog droppings.

SUMMARY OF THE INVENTION

The object of this invention is to provide a handheld grabbing assembly which is used in combination with a plastic bag supplying device so as to facilitate picking up and disposal of waste on the ground.

According to this invention, the handheld grabbing assembly includes a plastic bag supplying device and a grabbing device. The plastic bag supplying device includes a spindle, a spool mounted rotatably on the spindle, and a reel of continuous lay-flat web sheet of plastic bags wound around the spool for reeling out a leading plastic bag to be torn off from the reel. The grabbing device includes first and second clutching arm members. The first clutching arm member has a first clutching blade end section, and a first handgrip end section which includes: a first elongated frame body that extends parallel to the first clutching blade end section; a pair of first lug members which respectively and transversely extend from two lateral sides of the first elongated frame body and which respectively define a first axle hole to be journalled by each end of the spindle; and an internal boss member which is disposed on an inner surface of each of the first lug members and around the first axle hole. The second clutching arm member has a second clutching blade end section and a second handgrip end section which includes a second elongated frame body that extends parallel to the second clutching blade end, and a pair of second lug members that respectively and transversely extend from two lateral sides of the second elongated frame body. Each of the second lug members defines a second axle hole to be journalled by the respective end of the spindle. The pair of second lug members are disposed respectively and are mounted pivotably on the first lug members around an axis of the first axle holes so as to flank the first lug members and so as to bring the first clutching blade end section toward the second clutching blade end section. A biasing member is disposed on the internal boss member to bias the first clutching blade end section toward the second clutching blade end section. When the first and second handgrip end sections are turned around the axis against biasing action of the biasing member, the first and second clutching blade end sections will be gaped from each other so as to permit fitting of an edge of the leading plastic bag around the gaped clutching blade end sections in preparation for picking up waste on a ground surface.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
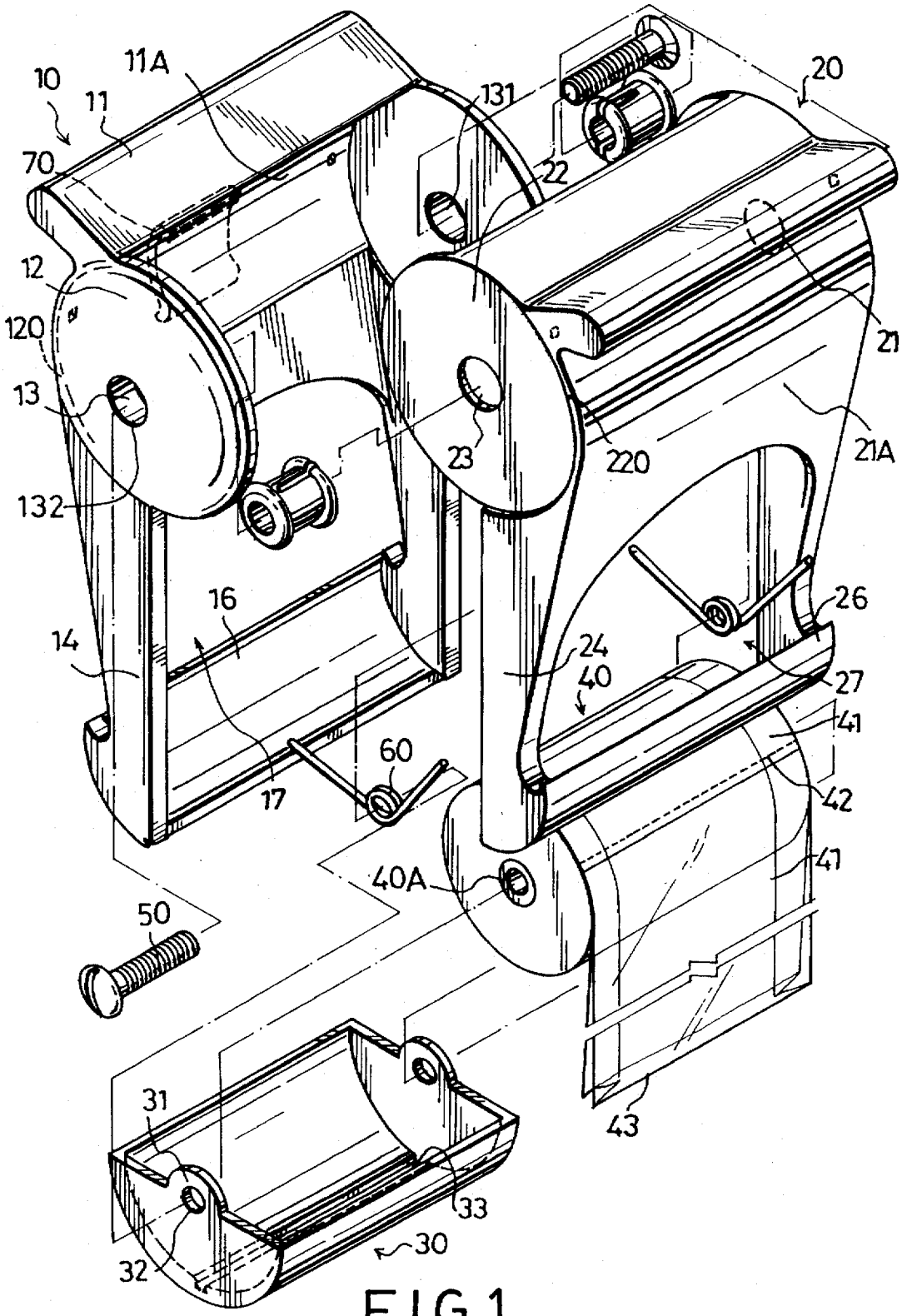
FIG. 1 is an exploded view of a handheld grabbing assembly of this invention.

Before the present invention is described in greater detail, it should be noted that same reference numerals have been used to denote like elements throughout the disclosure.

Figure 2:
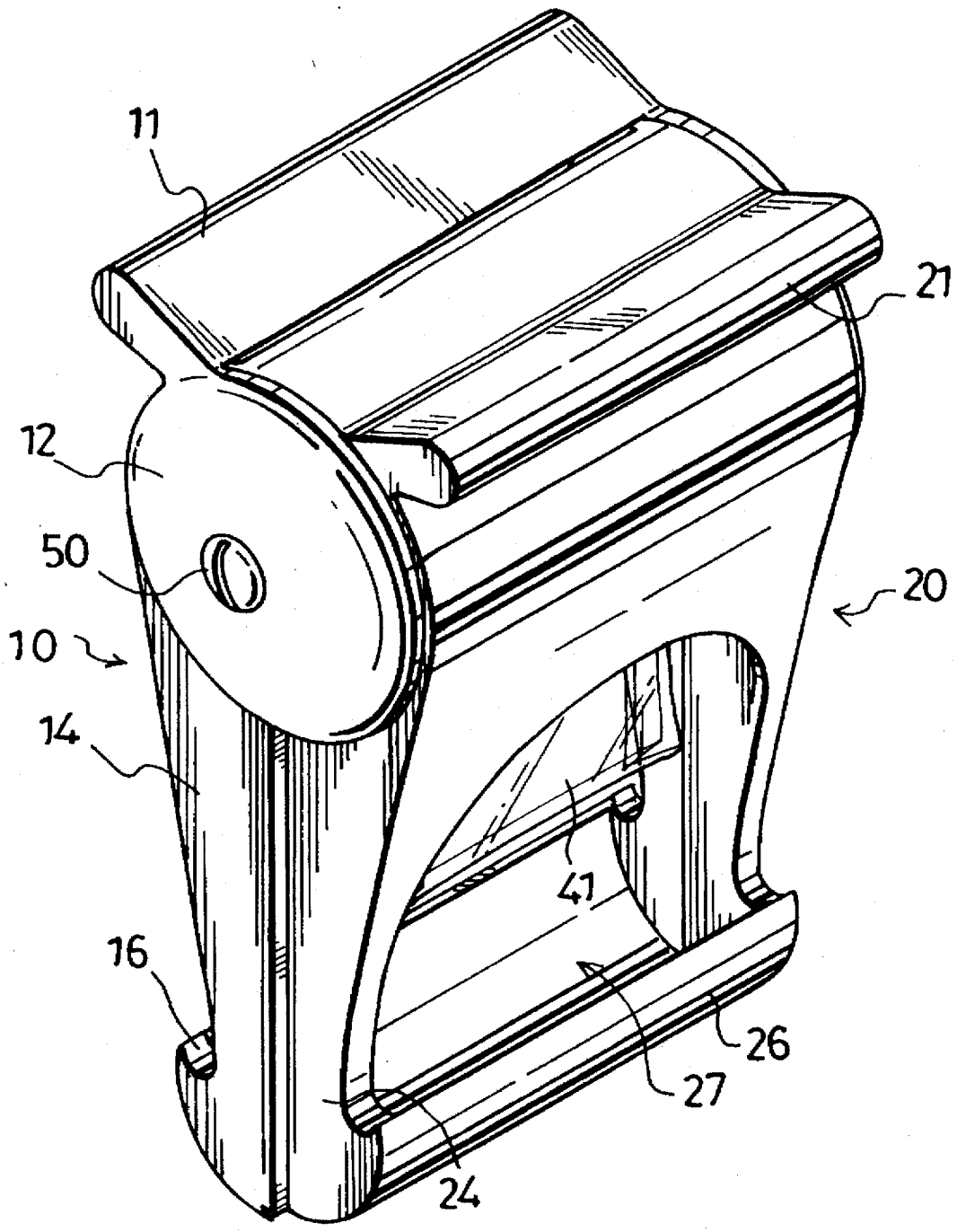
FIG. 2 is a perspective view of the grabbing assembly of this invention.

Referring to FIGS. 1 and 2, the first preferred embodiment of a handheld grabbing assembly according to this invention is shown to comprise a plastic bag supplying device and a grabbing device. The plastic bag supplying device includes a spindle 50 in the form of two bolts, a tubular-shaped spool 40A mounted rotatably on the spindle 50, and a reel 40 of continuous lay-flat web sheet of plastic bags 41 wound around the spool 40A for dispensing or reeling out a leading plastic bag 41 to be torn off from the reel 40A. A plurality of score lines 42 are formed between any adjacent two of the bags 41 in order to facilitate the tearing of a leading bag 41.

The grabbing device includes first and second clutching am members 10, 20. The first clutching arm member 10 has a first clutching blade end section 16, and a first handgrip end section 11 which includes a first elongated frame body 11A that extends parallel to the first clutching blade end section 16, and a pair of disc-shaped first lug members 12 which respectively and transversely extend from two lateral sides of the first elongated frame body 11A and which respectively define a first axle hole 13 to be journalled by a respective end of the spindle 50. Each of the first lug members 12 has an internal boss member 131 and an external boss member 132 disposed respectively on inner and outer surfaces thereof around the first axle hole 13. The internal boss member 131 and the external boss member 132 together constitute a bushing-shaped member which can be inserted into the first axle hole 13 so as to be journalled by the spindle 50.

The second clutching arm member 20 has a second clutching blade end section 26 and a second handgrip end section 21 which includes a second elongated frame body 21A that extends parallel to the second clutching blade end section 26, and a pair of second lug members 22 that respectively and transversely extend from two lateral sides of the second elongated frame body 21A. Each of the second lug members 22 defines a second axle hole 23 to be journalled with the respective end of the spindle 50. Prior to the insertion of the spindle 50 into the holes 13, 23 of the first and second clutching members 10, 20, the second lug members 22 are disposed on the first lug members 12 so as to flank the first lug members 12 and so as to align the axle holes 13, 23 with one another. Under this condition, the lateral wall portions of the first and second lug members 12, 22 are opposite to each other and are rotatable relative to each other around the bushing-shaped member. The lateral wall portions of the first and second lug members 12, 22 respectively include first and second curved curb segments 120, 220 which extend axially and respectively from a peripheral portion of the disc-shaped lug members 12, 22 in opposite directions. The curved curb segments 120, 220 cooperatively confine a guiding path for guiding the lug members 12, 22 during rotation relative to one another. Note that the first clutching arm member 10 further has a clip unit 70 fixed on the elongated frame body 11A so that the grabbing assembly can be clipped to the belt of the user.

Figure 3:
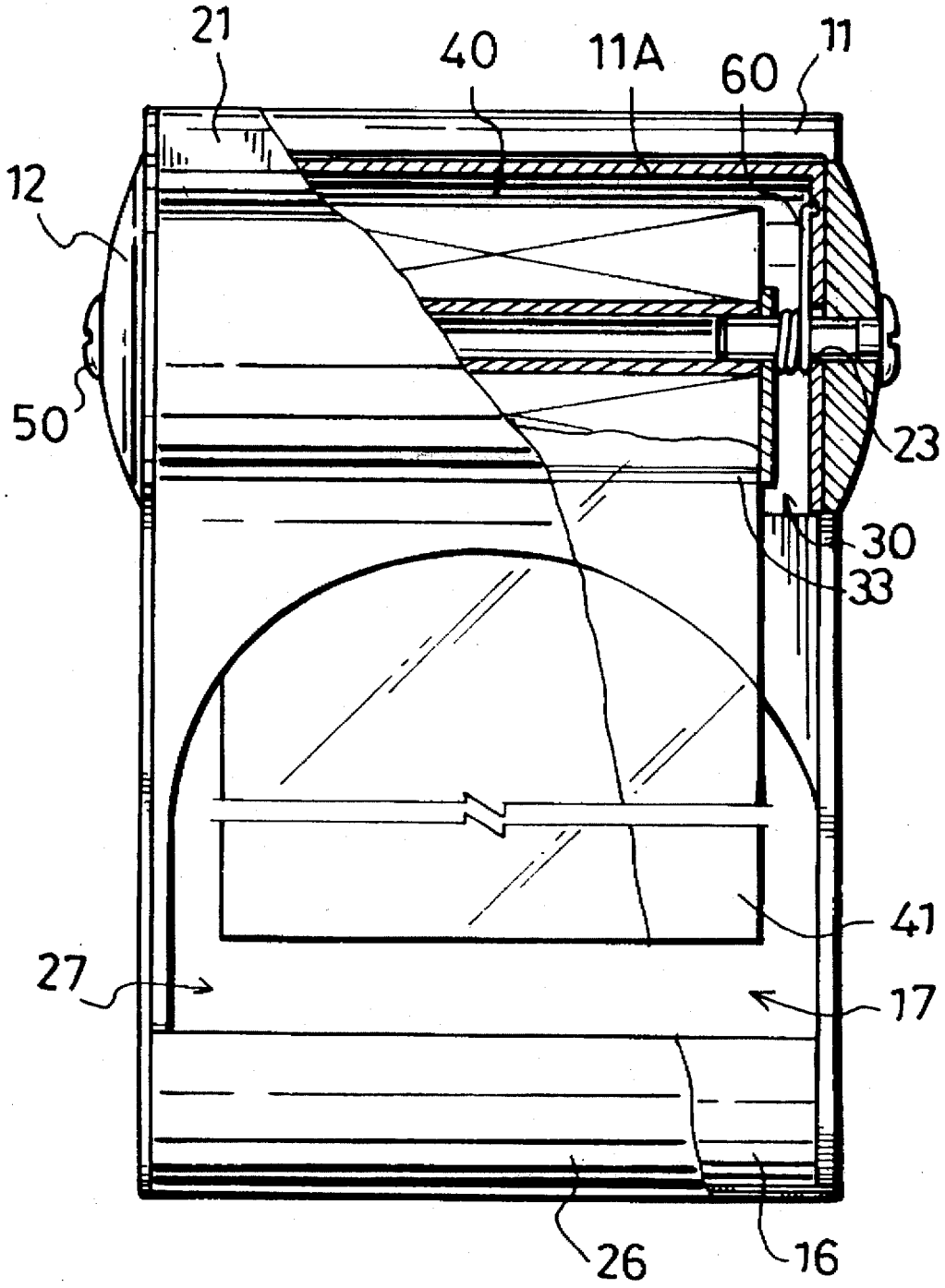
FIG. 3 is a partially sectional view illustrating the interior of the upper section of the grabbing assembly of this invention.

Referring to FIGS. 1 to 3, a biasing member 60, in the form of a coil spring with two end portions, is disposed on the internal boss member 131 to bias the first elongated frame body 11A so as to push the first clutching blade end section 16 toward the second clutching blade end section 26 of the second clutching arm member 20. Each of the first and second clutching arm members 10, 20 has an intermediate section interposed between the lug members 12, 22 and the clutching blade end section 16, 26 to define a semicircular opening 17, 27 formed therethrough adjacent to the respective clutching blade end section 16, 26. The intermediate section of the first and second clutching arm members 10, 20 respectively has two parallel plates 14, 24 formed between two lateral sides of the respective clutching blade end section 16, 26 and the respective lug members 12, 22. A trough body 30 is disposed in the grabbing device so as to enclose the reel 40 therein and has an elongated lower slit 33 for passage of the leading bag 41 therethrough, and two opposed wall sections 31 which are provided with holes 32 for extension of the spindle 50.

Figure 4:
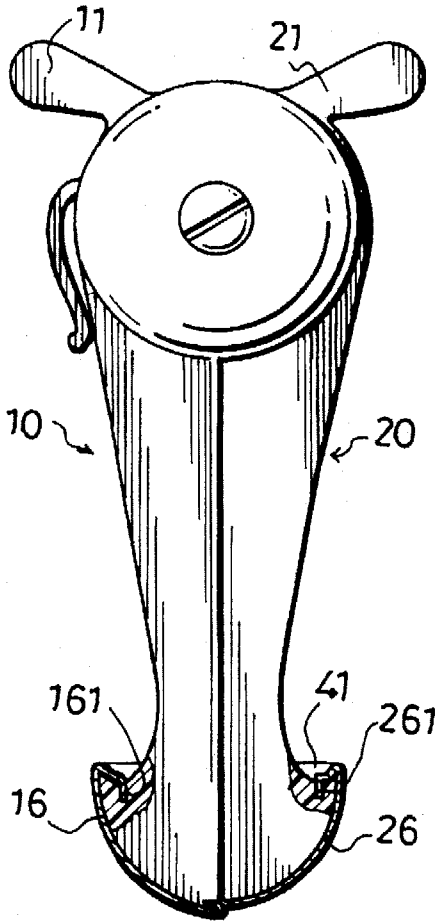
FIG. 4 is a partially sectional view of the grabbing assembly of this invention, illustrating a lower section thereof.
Figure 5:
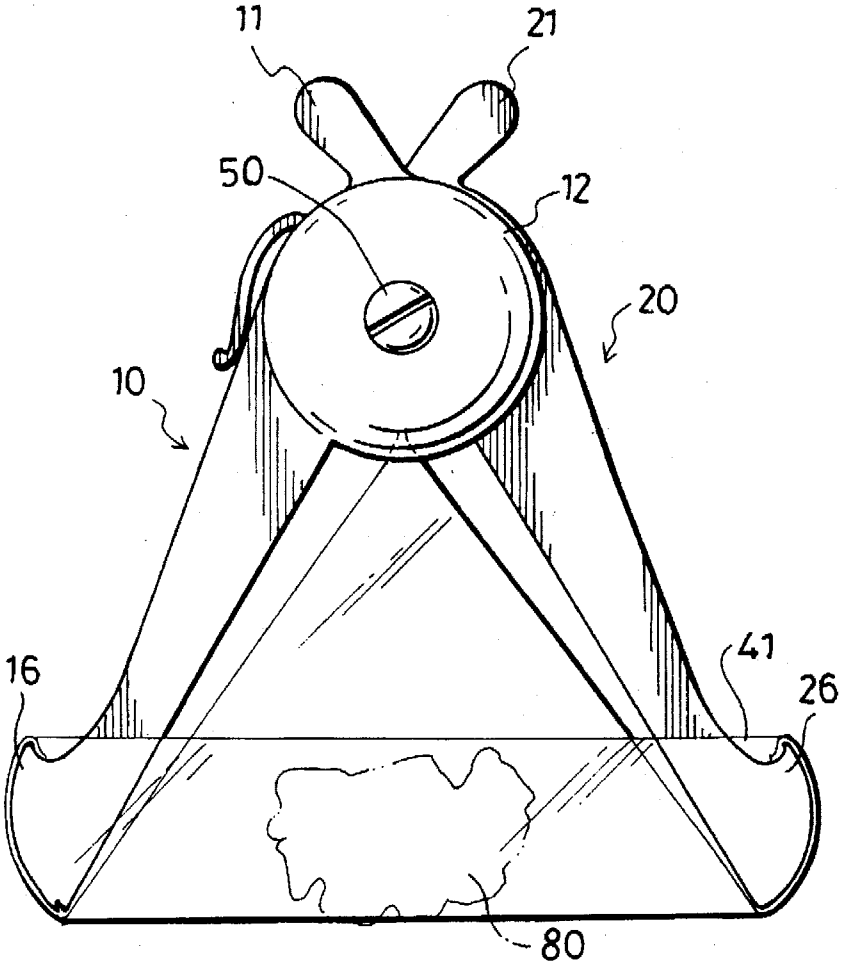
FIG. 5 shows the grabbing assembly of this invention when the lower clutching blade end sections are expanded in order to pick up waste on the ground.

Referring to FIGS. 4 and 5, the clutching blade end sections 16, 26 of the first and second clutching arm members 10, 20 are respectively formed with downwardly bent hook portions 161, 261 which permit the peripheral edge 43 (see FIG. 1) of the bag 41 to be hooked thereto. When the first and second handgrip end sections 11, 21 are turned around the spindle 50 against the biasing action of the biasing member 60 (see FIG. 1) so as to bring the same toward each other, the first and second clutching blade end sections 16, 26 expand radially and outwardly so as to be gaped from each other in order for waste material 80 to be picked up from the ground and put into the plastic bag 41 upon release of the pressure on the first and second handgrip end sections 11, 21.

Figure 6:
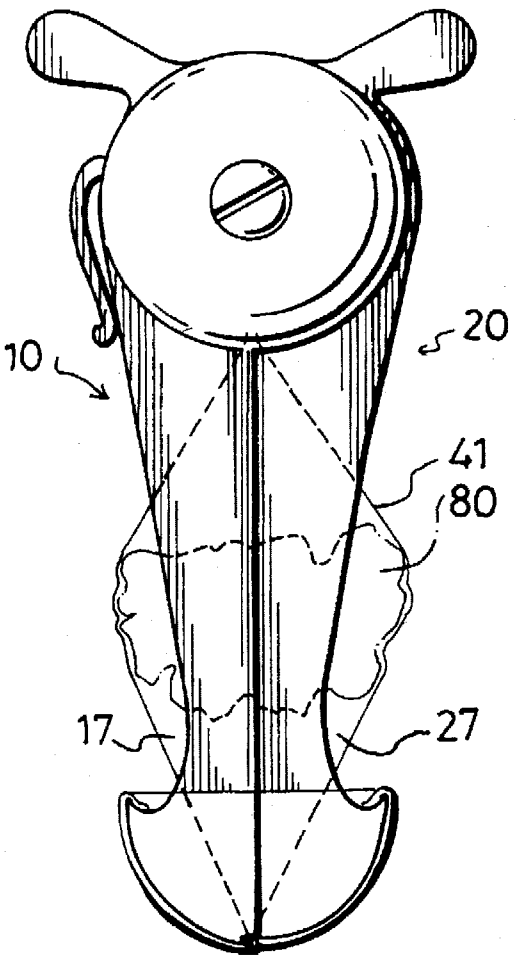
FIG. 6 illustrates the grabbing assembly of this invention when in use.

As illustrated in FIG. 6, the semi-circular openings 17, 27 in the first and second clutching arm members 10, 20 permit extension of the plastic bag 41 therethrough in the event that the waste 80 has a relatively large size.

Figure 7:
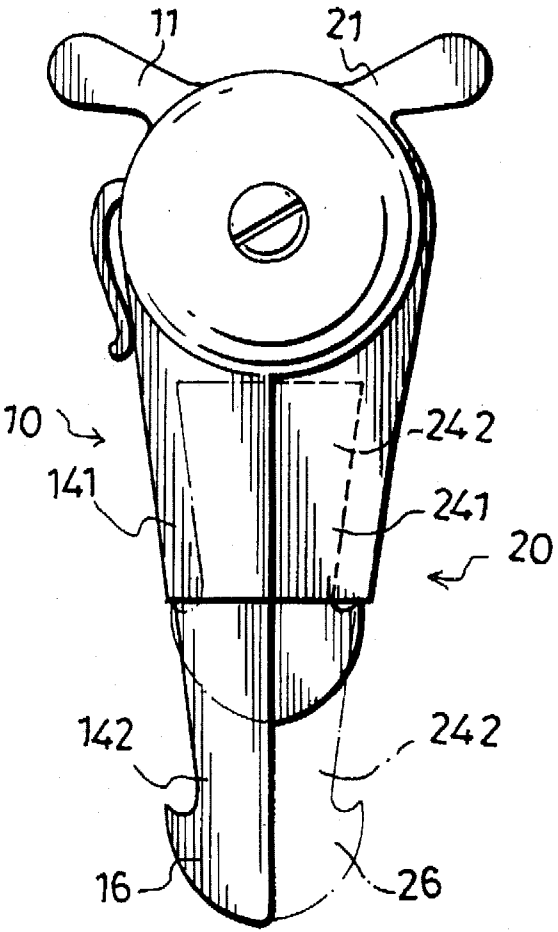
FIG. 7 is a side view of another preferred embodiment of the handheld grabbing assembly of this invention.
Figure 8:
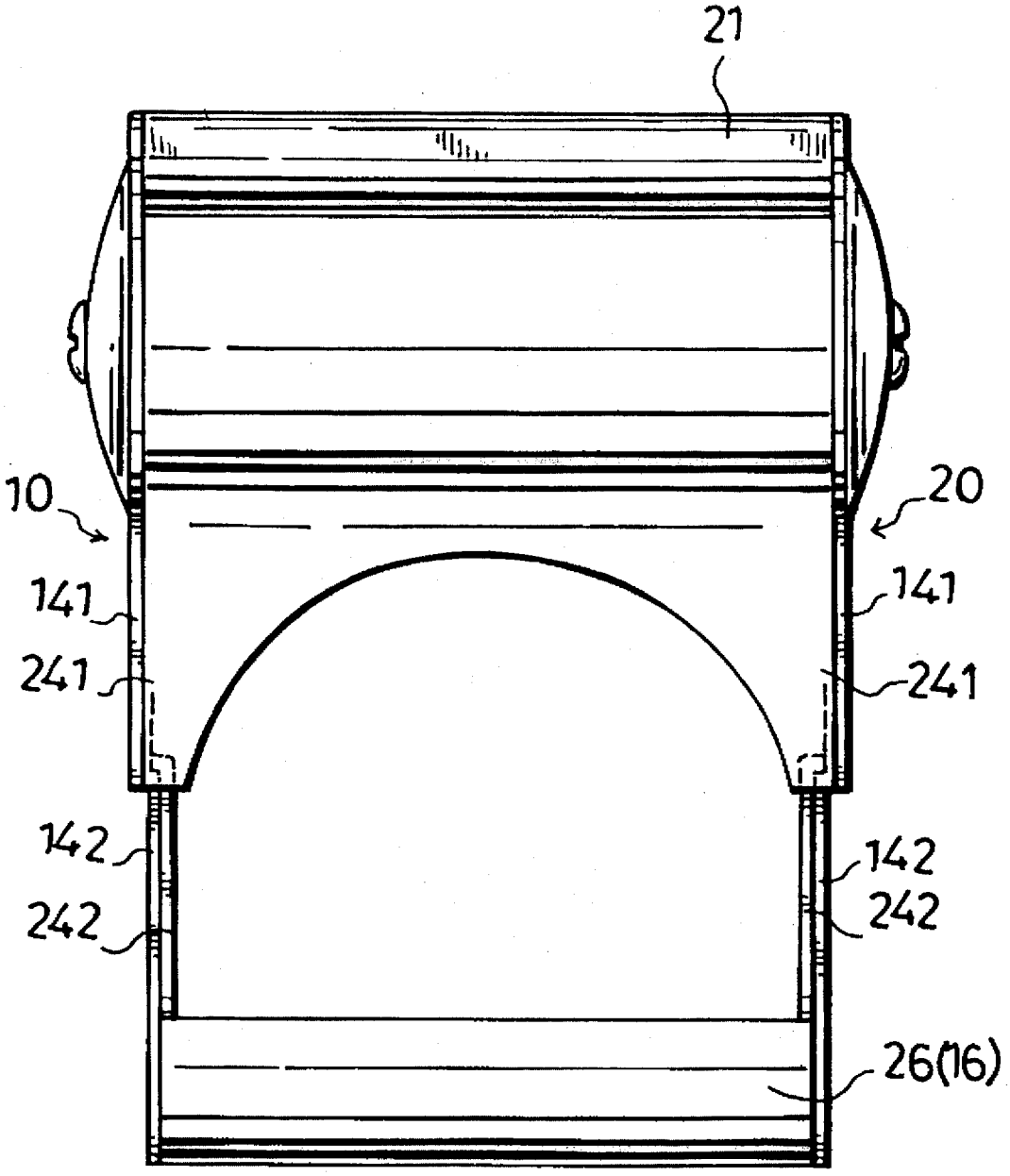
FIG. 8 is a front view of the grabbing assembly of FIG. 7.

Referring to FIGS. 7 and 8, the second preferred embodiment of a grabbing assembly according to this invention is shown to be similar in structure to the first embodiment, except that each of the first and second clutching arm members 10, 20 includes a handgrip end section 11, 21, a clutching blade end section 16, 26, and an intermediate section 142, 242 which is integrally formed with the clutching blade end section 16, 26 and which can be inserted telescopically into the lower portions 141, 241 of the frame body in the handgrip end section 11, 21 when not in use so as to facilitate storage thereof.

It has thus been shown that the grabbing assembly of this invention can facilitate picking up and disposal of pet droppings. Accordingly, the object of this invention is thus met.

With this invention thus explained, it is apparent that numerous modifications and variations can be made without departing from the scope and spirit of this invention. It is therefore intended that this invention be limited only as indicated in the appended claims.

I claim:

1. A handheld grabbing device used in combination with a plastic bag supplying device, said plastic bag supplying device including a spindle, a spool mounted rotatably on said spindle, and a reel of continuous lay-flat web sheet of plastic bags wound around said spool for reeling out a leading plastic bag to be torn off from said reel, comprising:

a first clutching arm member having a first clutching blade end section and a first handgrip end section which includes a first elongated frame body extending parallel to said first clutching blade end section;

a pair of first lug portions respectively and transversely extending from two lateral sides of said first elongated frame body, each of said first lug portions defining a first axle hole adapted to be journalled by a respective end of said spindle; and a boss member formed on an inner surface of each of said lug portions and around said first axle hole;

a second clutching arm member having a second clutching blade end section, and a second handgrip end section which includes a second elongated frame body extending parallel to said second clutching blade end section, and a pair of second lug portions respectively and transversely extending from two lateral sides of said second elongated frame body, each of said second lug portions defining a second axle hole adapted to be journalled by said respective end of said spindle, said pair of second lug portions being disposed respectively to flank said pair of first lug portions, and being mounted pivotably on said first lug portions around an axis of said first axle holes so as to bring said first clutching blade end section toward said second clutching blade end section; and a biasing member disposed on said boss member to bias said first clutching blade end section toward said second clutching blade end section;

whereby, when said first and second handgrip end sections are turned toward each other against biasing action of said biasing member, said first and second clutching blade end sections will be gaped apart from each other for picking up waste therebetween.

2. The handheld grabbing device according to claim 1, further comprising an external boss member disposed on an outer surface of each of said first lug portions and around said first axle hole so as to mount rotatably one of said second lug portions by sleeving said second axle hole on said external boss member thereof.

3. The handheld grabbing device according to claim 2, wherein said internal boss member and said external boss member cooperatively constitute a bushing-shaped member adapted to be journalled with said spindle.

4. The handheld grabbing device according to claim 2, wherein said first and second lug members respectively have first and second disc-shaped lateral wall portions opposite to each other and rotatable relative to each other around said external boss member, said first and second disc-shaped lateral wall portions respectively including first and second curved curb segments that axially and respectively extend from transverse peripheries of said disc-shaped lateral wall portions in opposite directions so as to confine and guide the peripheries of the opposing disc-shaped lateral wall portions.

5. The grabbing device according to claim 1, wherein each of said first and second clutching arm members includes an intermediate section which is disposed between said blade end section and said handgrip end section, and which has a semi-circular opening formed therethrough transverse to said first axle hole.

6. A grabbing assembly comprising:

a plastic bag supplying device including, a spindle, a spool mounted rotatably on said spindle, and a reel of continuous lay-flat web sheet of plastic bags wound around said spool for reeling out a leading one of the plastic bags to be torn off from said reel; and a handheld grabbing device including a first clutching arm member having a first clutching blade end, and a first handgrip end which includes a first elongated frame body extending parallel to said first clutching blade end, a pair of first lug members respectively and transversely extending from two lateral sides of said first elongated frame body, each of said first lug members defining a first axle hole to be journalled by a respective end of said spindle, and an internal boss member disposed on an inner surface of each of said first lug members and around said first axle hole;

a second clutching arm member having a second clutching blade end and a second handgrip end which includes a second elongated frame body extending parallel to said second clutching blade end, and a pair of second lug members respectively and transversely extending from two lateral sides of said second elongated frame body, each of said second lug members defining a second axle hole to be journalled by said respective end of said spindle;

said pair of second lug members being disposed respectively to flank said pair of first lug members, and being mounted pivotably on said first lug members around an axis of said first axle holes so as to bring said first clutching blade end toward said second clutching blade end; and a biasing member disposed on said internal boss member to bias said first clutching blade end toward said second clutching blade end;

whereby, when first and second handgrip ends are turned around said axis against biasing action of said biasing member, said first and second clutching blade end will be gaped from each other so as to permit fitting of an edge of a mouth of the leading plastic bag around said gaped clutching blade end in preparation for picking up waste on a ground surface.

7. The grabbing assembly according to claim 6, further comprising an external boss member disposed on an outer surface of each of said first lug members and around said first axle hole for sleeving rotatably said second lug members thereon.

8. A grabbing assembly according to claim 7, wherein said internal boss member and said external boss members cooperatively constitute a bushing-shaped member adapted to be journalled with said spindle.

9. The grabbing assembly according to claim 7, wherein said first and second lug members respectively have first and second disc-shaped lateral wall portions opposite to each other and rotatable relative to each other around said external boss member, said first and second disc-shaped lateral wall portions respectively including first and second curved curb segments that axially and respectively extend from transverse peripheries of said disc-shaped lateral wall portions in opposite directions so as to confine and guide the peripheries of the opposing disc-shaped lateral wall portions.

* * * * *